US007861636B1

(12) United States Patent
Hoffman

(10) Patent No.: US 7,861,636 B1
(45) Date of Patent: Jan. 4, 2011

(54) MUZZLE FLASH SUPPRESSOR

(75) Inventor: Brian R. Hoffman, Bangor, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 97 days.

(21) Appl. No.: 11/763,252

(22) Filed: Jun. 14, 2007

Related U.S. Application Data

(60) Provisional application No. 60/821,737, filed on Aug. 8, 2006.

(51) Int. Cl.
*F41A 21/34* (2006.01)

(52) U.S. Cl. ..... 89/14.2; 89/14.3

(58) Field of Classification Search ..... 89/14.2, 89/14.3, 14.05
See application file for complete search history.

(56) References Cited

U.S. PATENT DOCUMENTS 2,340,821 A * 2/1944 Russell ..... 42/76.01
3,171,010 A * 2/1965 Potter ..... 219/75
3,483,794 A * 12/1969 Packard ..... 89/14.2
4,546,564 A * 10/1985 A'Costa ..... 42/78
5,596,161 A * 1/1997 Sommers ..... 89/14.2
5,883,328 A * 3/1999 A'Costa ..... 89/14.2
6,722,254 B1 * 4/2004 Davies ..... 89/14.3

OTHER PUBLICATIONS

Headquarters, U.S. Army Materiel Command, "Engineering Design Handbook: Guns Series; Muzzle Devices" AMC Pamphlet, Document No. AMCP 706-251, May 1968.

* cited by examiner

*Primary Examiner*—Bret Hayes
*Assistant Examiner*—Reginald Tillman, Jr.
(74) *Attorney, Agent, or Firm*—John F. Moran

(57) ABSTRACT

A flash suppressor of the open prong type having a twist in its structure formed of alternating grooves and flutes or prongs provides a highly effective flash suppression for small and medium caliber weapons and especially for automatic weapons and machine guns when placed on the end of their barrels. The orientation of the direction of the twist of the structure is in a direction opposite to the direction of the rifling in its firearm barrel. Various objective laboratory tests and subjective user evaluation on its performance prove out its effectiveness in terms of mitigating visible flash on shorten machine gun barrels as well as standard full length barrels used in critical helicopter black out operations using night vision equipment. In addition, precise aiming of a weapon equipped with the inventive flash suppressor exhibits lower dispersion of actual projectile impact compared to conventional flash suppressors.

12 Claims, 3 Drawing Sheets

MUZZLE FLASH SUPPRESSOR

FIELD OF INVENTION

This invention relates to muzzle devices for weapons or firearms that use explosive force to propel projectiles at high velocity and more particularly to devices for reducing the flash associated with firing such weapons.

BACKGROUND OF INVENTION

Visible light signatures exist on nearly all weapons to some degree and are problematic for a number of reasons including not the least of which is indicating the gun position and also possibly the orientation of the weapon to opposing forces upon firing. The intensity of the visible light signature tends to vary from weapon to weapon, but generally speaking the problem is compounded when firing automatic weapons due to an increase in operating temperature of the barrel as well as an increase in physical wear and material degradation of the bore in the gun barrel. Periodically firing tracer rounds to aid in target acquisition, which is also a common practice, also tends to catalyze the onset of flash. There are many situations where visible flash is incompatible with military mission objectives, and as a result muzzle flash suppressors are often used to reduce the visible light signature on small and medium caliber weapons.

The United States Army has been studying this problem and has developed designs for a number of flash suppressors. The US Army Material Command has published a coordinated series of engineering design handbooks containing basic information and development of Army material and systems. In May 1968, a handbook as one of a series on guns entitled Muzzle Devices presents information on the fundamental operating principles and design of muzzle devices. These muzzle devices include muzzle brakes, blast deflectors, and flash suppressors. In the preface of this publication, one particular statement, which is still pertinent and highly appropriate today states that the effort to improve all muzzle devices continues, and this effort is being augmented by studies on human behavior when exposed to the phenomena created at the gun muzzle.

Flash suppressors have been recognized as a significant problem for betraying gun position since World War I. The search for a flash eliminator or an effective flash suppressor became almost as intense as the search for a higher performing gun although it has lagged since flash suppressor behavior was not fully understood and continues to be the subject of faulty explanations of their theory of operation. In Chapter 5 of the handbook entitled Flash Suppressors, the bar type, which is now often referred to as the open-prong type, or the open-cage type, for smaller caliber weapons, is considered including computerized analysis of the modifications to gas flow upon firing of the weapon. While the bar type is just one example, a variety of muzzle flash suppression devices have existed for some time yet none of them completely eliminate flash in all cases.

The combination of reduced length of the M240B lightweight short barrel along with its use on the fully automatic M240B medium machine gun involving sustained gunfire presents a significant challenge to the effectiveness of most traditional flash suppressor designs in terms of reducing visible light signature. Flash reduction for the family of M240 machine guns also becomes especially important when considering the detrimental effects of visible light during operations conducted in black out mode using night vision equipment. One of the most effective muzzle flash suppressors tested to date on the M240B lightweight short barrel is an open-prong design with angled flutes in the direction of rifling. This flash suppressor is similar to the design disclosed in U.S. Pat. No. 5,596,161 of Sonja Sommers that is available from SMITH ENTERPRISE, INC.

SUMMARY OF THE INVENTION

It is an object of the present invention to provide an effective flash suppressor adapted to be attached to the terminal end of its host barrel that is relatively short in length and adds minimal weight to its barrel.

It is a primary object of the present invention to provide a highly effective flash suppressor which operates in a manner having minimal deleterious impact of the true aim of the projectiles being fired from the weapon equipped with the inventive flash suppressor It is yet another object of this invention to provide a flash suppressor having minimal impact on a gunner and the operation of the weapon itself during aiming of the weapon as well as reduced light signature intensity for reducing the effect on the operation of night vision equipment.

A further related object of the invention is to reduce the effect of the light signature on associated personnel operating a helicopter while using night vision equipment as it transports the firearm weaponry during military operations including assault missions.

The present invention provides an alternative arrangement and new design which contradicts the teaching of U.S. Pat. No. 5,596,161 attributing its improved performance over conventional open prong designs by virtue of the fact that its plurality of flutes are oriented in the same direction (typically clockwise) of the rifling of the barrel bore. Specifically, the present invention departs from the teaching of the Sommers patent since its plurality of flutes are oriented in a direction specifically opposite to the direction of rifling in the bore of the barrel. Orientation of the helical flutes opposite to the direction of rifling assists in mitigating flash by reducing the available kinetic energy of the exiting propellant gases. Performance may also be enhanced through the partial destructive interference of the developing shock boundaries as well as the introduction of turbulence early in the flow pattern prior to departure from the physical envelope of the muzzle device. The results from a variety of tests indicate the performance of this new invention is in every aspect as good or better than the prior art flash suppressors including the Sommers flash suppressor. An additional and especially advantageous feature of the inventive flash suppressor is reduced dispersion. That is the minimization of any offset from the impact point of individual projectiles to the center of impact from a group of projectiles being fired.

The proposed muzzle flash suppressor was developed for the M240B lightweight short barrel. Moreover, the current critical application for this weapon is aboard helicopter equipped with M240 machine guns using standard full length barrels that conduct night missions wherein a highly effective flash suppressor is required to ensure reliable operation of night vision systems which would otherwise overload and malfunction due to any significant visible flash produced by firing the weapon during black out operations. The new muzzle flash suppressor performs better than traditional open-prong flash suppressors and as well or better than the patented open-prong design with flutes oriented in the direction of rifling. The successful performance of this new and contradictory design clearly illustrates that the governing dynamics attendant to muzzle flash and flash suppression are still not comprehensively understood. It should also be noted that while the proposed device was developed to meet the specific flash suppression requirements of the M240B lightweight short barrel, the new design is readily applicable to all small and medium caliber weapons of varying barrel lengths and may be conveniently used to advantage on a variety of weapons.

An open prong flash suppressor with helical slots opposing the direction of barrel rifling is particularly effective at reducing visible flash due to its influence on the kinetic energy of the exiting gases. Performance may also be enhanced by its affect on the combustion of gases prior to muzzle exit as well as existing geometric conditions catalytic to partial destructive interference of the developing shock boundaries ultimately responsible for the majority of visible light associated with a secondary flash condition.

The present invention utilizes a plurality of prongs separated by a plurality of slots or a structure of alternating prongs and slots forming a cage-like exhaust chamber or structure with discontinuous walls. This structure and its members possess a directional twist or orientation direction opposite to the direction of the rifling present in the gun barrel of the weapon. This directional orientation or twist however can be achieved in two ways which are not readily apparent from the depictions of illustrative embodiments of the flash suppressors of the present invention as shown due to their subtle differences in the dimensions of the drawings. The first method is to provide straight prongs or furcating members and straight grooves that are angled relative to the central axis of the flash suppressor to oppose the instantaneous angular orientation of the barrel rifling relative to the central axis of the flash suppressor or barrel. The second method involves the fabrication of true helical slots or prongs to provide an inventive flash suppressor whose rotational direction opposes that of the barrel rifling. In addition, a variety of combinations of these two methods may be used to advantage in constructing various inventive flash suppressors.

DETAILED DESCRIPTION OF THE PREFERRED EMBODIMENT

Figure 1:
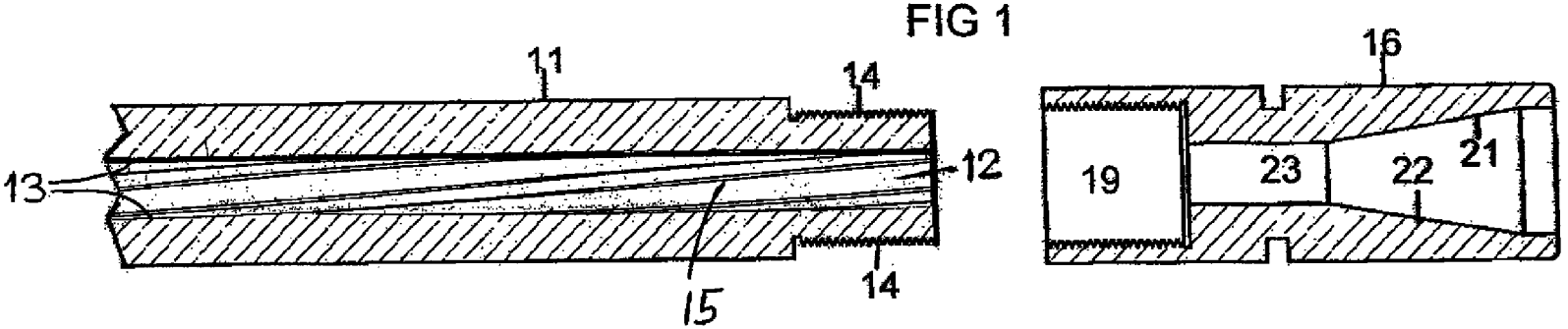
FIG. 1 illustrates cross sectional views of the end portion of a weapon barrel 11 and a flash suppressor 16 showing axially aligned passage 23 surrounding the travel path of projectiles (not shown) as they are fired from left to right as they exit flash suppressor 16.

In FIG. 1, a cross sectional view of the end portion of a weapon barrel 11 is depicted having a central axial bore 12 wherein its cylindrical wall 13 is rifled 15 in accordance with conventional practices for the well known purpose of stabilizing the projectile as it departs from the weapon. The barrel includes a terminal end portion possessing an attachment arrangement including an external threaded portion 14 designed to interface with a flash suppressor 16 through an internal threaded portion 19 for screw on attachment although any convenient attachment arrangement may be used to advantage. Cross sectional areas 21 and 22 illustrate the shape of an internal conical passage way that leads from axial passage 23 and is axially aligned with bore 12 of barrel 11. The shape of cross sectional areas 21 and 22 depict the general configuration of the internal geometry leading from passage way 23 and extending to the terminal end of flash suppressor 16.

In addition to using fastening arrangement of threads for the inventive flash suppressor various other fastening arrangements may be used. For example, set screws may be utilized to lock the flash suppressor in place on the end portion 14 of barrel 11, which may or may not possess an area of reduced diameter. In some cases, it may be desirable to machine the flash suppressor and the gun barrel from the same metal piece to form a gun barrel integrated with the inventive flash suppressor. Also the new applications being found suitable for new high performance composite materials may utilize an adhesive bonding application for fastening the flash suppressor to the rifled gun barrel. Other suitable attachment arrangements may be readily devised by those skilled in the art. In each case, the materials selected should provide suitable performance accordance with the physical demands on this material application as well as desired temperature performance characteristics.

Figure 2:
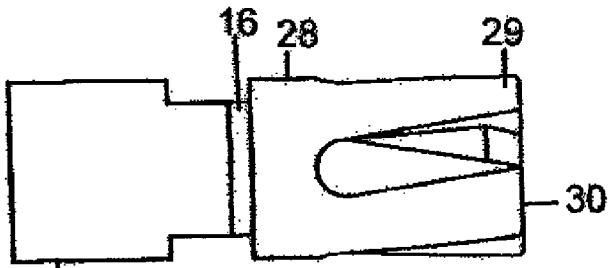
FIG. 2 is a top view depicting the geometry of the configuration of flash suppressor 16.

FIG. 2 is a top view of the inventive flash suppressor 16 wherein coupling end 26 mates or interfaces with barrel 11 while a body portion 28 includes a configuration of alternating prongs, such as prongs or furcating members 29 and 30 separated by a plurality of slots or grooves, forming a plurality of furcations which extend from body portion 28 to the exiting end of flash suppressor 16 cylindrically disposed about axial passage way 23. The axial orientation of flash suppressor 16 in FIG. 2 is selected to illustrate a typical flat sectional portion of the flash suppressor wherein a wrench tool (not shown) may be placed for tightening the suppressor on barrel 11.

Figure 3:
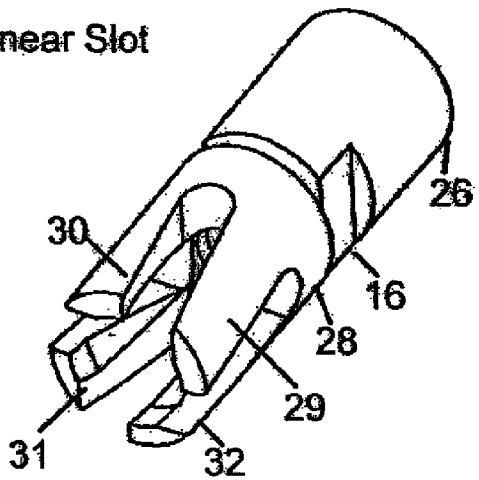
FIG. 3 further illustrates the general configuration of flash suppressor 16 in an isometric view.

In FIG. 3, the alternating furcation structure and slots is clearly shown in an isometric view of flash suppressor 16. End 26 interfaces with the barrel (not shown) which provides a highly desired cage-like configuration extending from body 28 enclosing passage way 23 wherein the furcations or prongs 29-32 extend from to form the cage-like configuration providing the exiting or operative end of flash suppressor 16. Although four prongs or furcating members are shown in the illustrative embodiments, the number may vary in accordance with the size of the gun barrel and bore in each specific application of the invention.

Figure 6A:
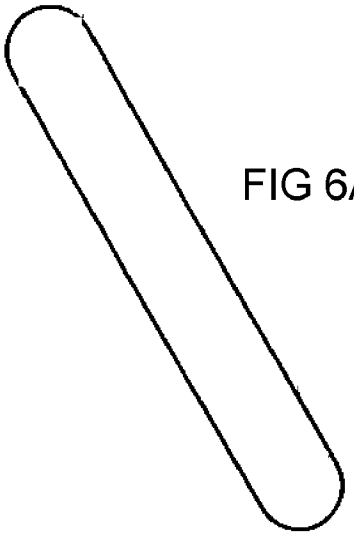
FIGS. 6A and 6B illustrate a first method or process of manufacturing straight slots between furcations angled relative to the longitudinal axis of the flash suppressor involving no rotation of the cutting tool axis over the length of the slot during machining.
Figure 6B:
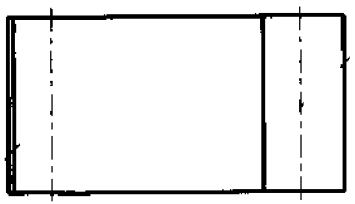

FIGS. 6A and 6B illustrate respective top view and front view of the tool path from start to finish of the cutting tool path. The process of manufacture, hereinafter designated as process 1, involves continuous straight slot formation that is angled relative to the longitudinal axis of the flash suppressor opposite to the rotational direction of the rifling in the weapon barrel. Over the length of each slot, the cutting tool axis remains parallel at a constant angle. While maintaining acceptable machine tolerances, the cutting tool axis passes through the longitudinal axis of the flash suppressor at a single location only. There are a number of variations involving the angle of slots between the furcations relative to the longitudinal axis of the flash suppressor.

Within process 1 a number of minor variations may be made. Process 1A is similar to process 1 except that the individual slot(s) are comprised of discrete straight segments of varying angle relative to the longitudinal axis of the flash suppressor. Process 1B is similar to either process 1 and 1A except the cutting tool axis at one end of the slot is intentionally offset from the longitudinal axis of the flash suppressor.

Figure 7A:
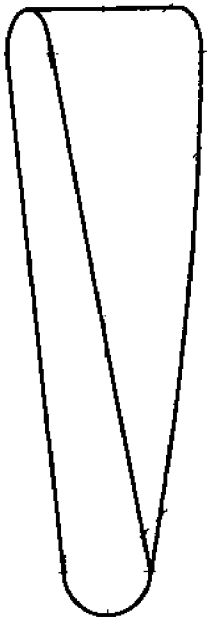
FIGS. 7A and 7B illustrate a second method or process of manufacturing helical slots between furcations involving the rotation of the cutting tool axis over the length of the slot during machining.
Figure 7B:
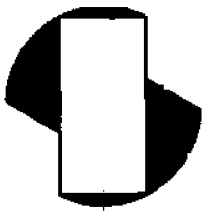

In accordance with the illustrations, FIGS. 7A and 7B serve to explain a manufacturing process involving the formation of true helical slot(s) with a rotational direction that opposes that of the barrel rifling. Over the length of each slot, the cutting tool axis sweeps an angle corresponding to the relative rotation between flash suppressor and cutting tool. Within acceptable machine precision and tool cutting tolerances, the cutting tool axis passes through the longitudinal axis of the flash suppressor at all times.

FIG. 7A demonstrates a top view of the cutting tool path from axis start to axis finish. FIG. 7B shows a front view of the cutting tool path from axis start to axis finish. This manufacturing process 2 involves the formation of helical slot(s) is subject to a number of variations designated as process 2A, process 2B and process 2C. In process 2A, the cutting tool sweeps through a nonlinear rate of angular rotation over the length of each slot. Process 2B is similar to either process 2 or 2A except the cutting tool axis is intentionally and constantly offset from the longitudinal axis of the flash suppressor over a partial or full length of each slot. Process 2C is similar to either process 2 or 2A except the cutting tool axis is intentionally and variably offset from the longitudinal axis of the flash suppressor over a partial or full length of each slot.

Another variation of the processes of manufacturing is possible by utilizing hybrid combinations of any of the foregoing process 1 and 2. Regardless of which slot manufacturing method or process is used, although it is generally assumed that the width of each slot is constant over its length a variable width slot may be created using more complex operations. In addition, when multiple slots are created in an inventive flash suppressor their width may not be uniform from slot to slot.

In spite of the foregoing variations in the machining process for various embodiments of the present invention, it should be understood that the fundamental principle of operation attributed to orienting the slots in a direction opposing that of the direction of rifling is the same.

Table 1 provides bullet dispersion data for both the standard full length and lightweight short barrels used on the family of M240 machine guns with each barrel fired using multiple flash suppressor configurations. Both M240 barrel configurations utilize right-hand (clockwise) rifling in the bore. Column 1 lists dispersion data for the inventive flash suppressor with a left-hand twist (counter-clockwise as viewed from chamber end of barrel towards the muzzle). Column 2 lists dispersion data for an open-prong flash suppressor with a right-hand twist (clockwise as viewed from chamber end of barrel towards the muzzle). Column 3 lists dispersion data for the flash suppressor used on the standard full length barrel. Column 4 lists dispersion data for the flash suppressor used on the MK48 barrel. Dispersion values are presented in centimeters and were obtained by firing an M240B machine gun using a series of cartridges and firing in full auto (repeating) mode to achieve sustained gunfire at a single intended location. The M240B machine gun is a product of Fabrique Nationale. The standard flash suppressor used on the standard full length barrel is described in Department of Army Field Manual No. 3-22.68, entitled "Crew-Served Machine Guns, 5.56 mm and 7.62 mm dated January 2002 which is a public document.

In Table 1, it is readily apparent that the lower values of the inventive flash suppressor in the vast majority of data listed indicates smaller dispersion which is clearly preferable by virtue of the fired projectiles are hitting closer to the intended (true aim) point of impact on the target. The data for the inventive flash suppressor indicates superior performance for 100 meters and 600 meters distance away from the target. The dispersion measurements are labeled: MR for mean radius (average radial distance Cl to impact point); RSD for radial standard deviation=square root ((HSD2+VSD2)*(N−1/N)); and ES for extreme spread (maximum distance between all possible pairs of impacts). MR is the average radius from the center of impact of the group to individual impact locations. ES is the extreme linear distance measured between the most extreme impacts in the group.

TABLE 1

| | Left Twist Suppressor | Right Twist Suppressor | Standard Suppressor | MK48 Suppressor |
|---|---|---|---|---|
| 100 Meters Short Barrel | | | | |
| MR | 4.2 | 5.0 | 4.8 | 5.0 |
| RSD | 4.6 | 5.7 | 5.5 | 5.7 |
| ES | 13.8 | 17.8 | 16.9 | 16.6 |
| 100 Meters Long Barrel | | | | |
| MR | 9.9 | 10.8 | 12.9 | 11.6 |
| RSD | 11.9 | 13.4 | 16.4 | 13.5 |
| ES | 35.5 | 35.1 | 41.4 | 32.3 |
| 600 Meters Short Barrel | | | | |
| MR | 24.0 | 28.1 | 27.1 | 27.0 |
| RSD | 26.4 | 31.0 | 31.6 | 30.8 |
| ES | 80.0 | 94.0 | 97.4 | 88.4 |
| 600 Meters Long Barrel | | | | |
| MR | 55.8 | 62.5 | 72.0 | 63.4 |
| RSD | 67.3 | 76.6 | 91.7 | 73.1 |
| ES | 194.9 | 196.6 | 231.6 | 181.4 |

Figure 4:
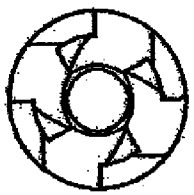
FIGS. 4 and 5 depict alternate end views of the exiting structure of slash suppressor 16 in accordance with two different fabrication processes for creating the slots.

In FIG. 4, an end view of a first embodiment of the invention is shown. This embodiment implements linear slots angled relative to the longitudinal axis of the flash suppressor.

Figure 5:
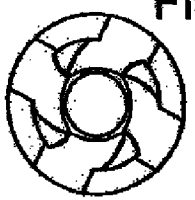

In FIG. 5, an end view is presented of another embodiment of the invention having true helical slots wherein the angular sweep of each of the slots over its entire length is about the longitudinal axis of the flash suppressor itself.

A number of tests were conducted to evaluate the flash suppression performance of the inventive flash suppressor wherein the helical flutes and corresponding prongs rotate in a direction that opposes that of the rifling in the gun barrel. Since it is common practice to provide rifling with a right-hand twist or clockwise, the orientation of furcations corresponds to a left-hand twist or counter-clockwise direction. It is also apparent if the rifling in the gun barrel has a left-hand twist or counter-clockwise rotational direction, a flash suppressor in accordance with the principles of the present invention would have furcations with a right-hand twist or clockwise orientation which would provide equally effective performance.

In addition to numerous photographic recordings to evaluate flash performance, a well-seasoned, experienced soldier using night vision equipment tested standard full length M240 barrels with the present invention and an equivalent to the Smith flash suppressor. This experienced marksman was unable to subjectively ascertain any difference in operation as far as flash suppressor characteristics were perceived. However data on projectile deviation indicates superior performance with less deviation in aiming and firing a weapon equipped with the inventive flash suppressor.

A detailed analysis of the dynamics of flash suppression for achieving highly desirable performance will be now presented.

As the exiting propellant gases undergo inelastic collisions with the helical prongs of the flash suppressor, the kinetic energy of those gases is not conserved. At a minimum, some of the energy due to the collision is transferred into thermal energy via frictional forces responsible for the momentum change of the particles. Some of the energy is also dissipated through the non-conservative forces performing work on the helical prongs as they undergo elastic strain. By implementing helical prongs with a rotational direction that opposes that of the barrel rifling, any angular momentum imparted on the propellant gases from the barrel rifling or rotation of the projectile is exploited and used to assist in the dissipation of kinetic energy. This is significant because the majority of visible light results from secondary flash that occurs when supersonic combustible propellant gases exit the system and catch up to the sonic oblique and normal shock waves that form the shock bottle. As the gases pass through the shock waves, their velocity and associated kinetic energy become the source for increased pressure and temperature. If these properties increase to the point of reaching or exceeding threshold levels for ignition, combustion begins and the flash condition prevails. By initially reducing the kinetic energy of the propellant gases, the likelihood of ignition after muzzle exit is reduced.

By physically opposing the angular rotation of propellant gases as they exit the muzzle, additional turbulence will also be introduced into the flow pattern. By introducing this early in the event, it is possible to increase the rate of combustion and allow for a more complete burn before any residual combustible gases leave the envelope of the muzzle device and the overall system. The turbulence must be introduced as early as possible, however, because once the propellant gases leave the system or are nearly departed, violent gas flow will only negate performance. This unwanted condition is most commonly observed in certain closed-end flash suppressors that disrupt the flow pattern near the end of their physical envelope as the propellant gases exit the muzzle device.

It is also postulated that the physical opposition of the helical slots may in fact precipitate the partial destructive interference of developing shock boundaries both forward and aft of the projectile. Destruction of the shock boundaries, even on a partial level, represents positive mechanical control of secondary flash because residual combustible gases are given fewer opportunities to increase their pressure and temperature and ignite.

While a number of illustrative embodiments of the invention have been shown and described, it is to be understood that within the application of the inventive principles various changes and modifications may be introduced in accordance with the skill of various practitioners in the art of the invention that are within the scope of the appended claims.

What is claimed is:

1. A flash suppressor attached to a terminal end of a weapon barrel, the weapon barrel having rifling in a first direction, wherein the first direction is either right-handed or left-handed spiraling for imparting a spin on projectiles in a direction determined by the rifling, the projectiles being fired by igniting a propellant to produce propelling gases; the flash suppressor comprising a plurality of flutes oriented in a direction opposite to the first direction of rifling, each of the flutes terminating in free space and the flutes forming an open cage structure for propelling gases exiting the weapon barrel forcing the projectile out of the weapon barrel wherein visible flash is substantially reduced upon firing.

2. The flash suppressor of claim 1 wherein the flutes are linearly formed and have an angular orientation opposite to that of the rifling.

3. The flash suppressor of claim 1 wherein the flutes are formed in a helical twist to form the open cage like structure for mitigating visible flash by reducing kinetic energy of exiting propellant gases.

4. A flash suppressor on a firing weapon having a gun barrel, the flash suppressor having means for attaching it to a terminal end of the gun barrel, the gun barrel having a bore with rifling in a first direction, wherein the first direction is either right-handed or left-handed spiraling the flash suppressor comprising a plurality of prongs separated from each other and terminating in free space forming an open ended cage structure and the prongs having an orientation for affecting the manner in which exhaust gases associated with firing exit the weapon, the orientation of the prongs having a directional twist that opposes the first direction of the rifling present in the bore of the gun barrel so that the interaction of the exhaust gases and the device mitigates visible flash by reducing kinetic energy of the exhaust gases.

5. A firearm muzzle flash suppressor comprising a generally cylindrical body member with a proximal end attached to a firearm barrel, the firearm barrel having a rifled bore in a first direction wherein the first direction is either right-handed or left-handed spiraling and an exiting end to which the flash suppressor is attached at the proximal end having a central axis aligned with the fire the rifled bore, the flash suppressor having an axial passage way having a diameter slightly greater than the rifled bore and connecting an exit chamber of a diameter substantially greater than the firearm bore, said exit chamber including a plurality of furcations having a directional orientation in a second direction opposite to the first direction of the rifled bore, and said exit chamber being an open cage structure wherein the furcations terminate in free space.

6. The firearm muzzle flash suppressor of claim 5 wherein the plurality of fin-cations are linearly formed to provide the directional orientation.

7. The firearm muzzle flash suppressor of claim 5 wherein the plurality of furcations are formed to provide a helical twist to provide the directional orientation.

8. The firearm muzzle flash suppressor of claim 5 wherein the plurality of furcations are formed to have a combination of angular and helical orientations to provide the direction of orientation.

9. A weapon tube in a gun having a rifled bore having a central axis, the rifled bore having rifling in a first direction of rotation wherein the first direction of rotation is either right-handed or left-handed spiraling a gun flash suppressor comprising a cylindrical body extending from the weapon tube, the flash suppressor having a central passage way aligned with the central axis of the bore of the weapon tube and an exit chamber extending from the passage way, the exit chamber having discontinuous walls being formed of furcations separated by slots, the slots extending fully to a distal end of the exit chamber, the furcations terminating in free space forming an open cage structure, and the furcations having a second directional orientation opposite to the first direction of rotation of the rifling of the rifled bore for mitigating flash from the weapon tube associated with operation of the gun upon firing.

10. The weapon tube of claim 9 wherein the furcations are linear and angularly offset to provide the directional orientation.

11. The weapon tube of claim 9 wherein the furcations have a helical twist to provide the directional orientation.

12. The weapon tube of claim 9 wherein the furcations have a combination of angular offset and a helical twist to provide the directional orientation.

* * * * *